US008632055B2

(12) United States Patent
Lee et al.

(10) Patent No.: US 8,632,055 B2
(45) Date of Patent: Jan. 21, 2014

(54) COMBINED CAR JACK AND LUG WRENCH ASSEMBLY

(75) Inventors: Judy Lee, Taipei (TW); Tony Ho, Taipei (TW); Ting-Hsien Wang, Tali (TW)

(73) Assignee: Test Rite Products Corp., Ontario (CA)

( * ) Notice: Subject to any disclaimer, the term of this patent is extended or adjusted under 35 U.S.C. 154(b) by 0 days.

(21) Appl. No.: 12/405,798

(22) Filed: Mar. 17, 2009

(65) Prior Publication Data

US 2011/0167566 A1 Jul. 14, 2011

Related U.S. Application Data

(63) Continuation-in-part of application No. 11/451,394, filed on Jun. 13, 2006, now abandoned, and a continuation-in-part of application No. 29/326,892, filed on Oct. 27, 2008, now Pat. No. Des. 593,723.

(51) Int. Cl.

| | |
|---|---|
| ***B66F 13/00*** | (2006.01) |
| ***B66F 5/02*** | (2006.01) |
| ***B66F 3/24*** | (2006.01) |
| ***B66F 1/04*** | (2006.01) |

(52) U.S. Cl.
USPC ..... 254/8 B; 254/108; 254/93 H; 254/1; 254/2 B

(58) Field of Classification Search
USPC . 254/2 B, 7 B, 7 R, 8 R, 9 B, 93 H, 8 B, 425, 254/93 R; 278/143, 145; 7/100, 167
See application file for complete search history.

(56) References Cited

U.S. PATENT DOCUMENTS

| | | | | |
|---|---|---|---|---|
| 1,721,756 | A | 7/1929 | Walker | |
| 2,697,370 | A * | 12/1954 | Brooks | 81/58 |
| 2,789,788 | A | 4/1957 | Wilson | |
| 4,018,421 | A | 4/1977 | Tallman | |
| D274,668 | S | 7/1984 | Eliasson | |
| 4,765,009 | A * | 8/1988 | Hung | 29/245 |
| 4,811,440 | A | 3/1989 | Scott | |
| 5,201,257 | A | 4/1993 | Engel | |
| 5,433,127 | A | 7/1995 | Messier | |
| D398,730 | S | 9/1998 | Lin | |
| D423,750 | S | 4/2000 | Hung | |
| 6,070,491 | A | 6/2000 | Claudio et al. | |
| 6,237,894 | B1 | 5/2001 | Cotner et al. | |
| 6,375,160 | B1 | 4/2002 | Hung | |
| 6,505,816 | B1 | 1/2003 | Hung | |
| 6,637,908 | B1 * | 10/2003 | Hung | 362/109 |
| D485,412 | S | 1/2004 | Hung | |
| 6,676,096 | B2 * | 1/2004 | Hung | 248/316.7 |
| 6,899,319 | B2 | 5/2005 | Hung | |
| D513,954 | S | 1/2006 | Richards | |
| D514,768 | S | 2/2006 | Ji | |
| D531,377 | S | 10/2006 | Liu | |

(Continued)

*Primary Examiner* — Monica Carter
*Assistant Examiner* — Seahee Yoon
(74) *Attorney, Agent, or Firm* — Tsircou Law, PC

(57) ABSTRACT

A combined car jack and lug wrench assembly is provided that includes a driving lever configured to be used both to engage a driving head for operating a hydraulic system of the car jack and to be used as a spanner of a lug wrench assembly. The assembly can include a car jack body, a socket storage assembly disposed on the body for housing wrench sockets, and a lever storage assembly disposed on a sidewall of the body configured to secure the driving lever along a sidewall of the body, when not in use.

4 Claims, 5 Drawing Sheets

(56) References Cited

U.S. PATENT DOCUMENTS

| | | | | |
|---|---|---|---|---|
| D540,504 | S | | 4/2007 | Mathieson |
| D544,674 | S | | 6/2007 | Hsieh |
| 7,334,774 | B1 | | 2/2008 | Lin |
| D571,072 | S | | 6/2008 | Kong et al. |
| D579,167 | S | * | 10/2008 | Lin ..... D34/31 |
| 2003/0136951 | A1 | | 7/2003 | Hung |

* cited by examiner

COMBINED CAR JACK AND LUG WRENCH ASSEMBLY

CROSS REFERENCE TO RELATED APPLICATIONS

This application is a continuation-in-part of U.S. Application No. 29/326,892, filed Oct. 27, 2008, and of U.S. application Ser. No. 11/451,394, filed Jun. 12, 2006, which are incorporated by reference.

FIELD OF THE INVENTION

The present invention relates generally to car jacks and, more particularly, to car jacks having a lug wrench assembly.

BACKGROUND OF THE INVENTION

Conventional car jacks a driving head 1, a driving lever 2 detachably attached to the driving head for turning by the user to bias the driving head and to further lift the car jack, and a rotary lock bolt 3 for locking the hydraulic system to hold the car jack in the lifted position. The driving head has a locating notch 4. The driving lever 2 has a locating pin 5 at the periphery. After insertion of the driving lever into the driving head, the driving lever is rotated through an angle to force the locating pin into positive engagement with the locating notch so that the driving lever can be pulled alternatively up and down to lift the car jack.

Although conventional car jack are generally effective, shortfalls exist. For example, the driving lever of conventional car jacks is specifically designed only for driving the driving head. For example, when wishing to rotate the rotary lock bolt 13, the user must have separate, additional tools for that purpose.

SUMMARY OF THE INVENTION

The invention provides a combined car jack and lug wrench assembly having a driving lever configured to be used both to engage a driving head for operating a hydraulic system of the car jack and to be used as a spanner of a lug wrench assembly. The assembly can include a car jack body, a socket storage assembly disposed on the body for housing wrench sockets, and a lever storage assembly disposed on a sidewall of the body configured to secure the driving lever along a sidewall of the body, when not in use.

In a detailed aspect of an exemplary embodiment, a driving lever has an elongated cylindrical body with a first end and a second end. The elongated body includes a coupling tip and an engaging portion. The coupling tip is proximate to the first end and has a rectangular cross section. A retaining knob disposed along a side of the coupling tip for mating with a wrench socket to the coupling tip In another detailed aspect of an exemplary embodiment, an engaging region of the driving lever is proximate to the second end configured to mate with the driving head of a hydraulic system The engaging region can further define a retaining hole axially at the second end configured to mate to a rotary lock bolt disposed proximate to the end portion of the body for operating a locking mechanism of the hydraulic system.

In yet another detailed aspect of an exemplary embodiment, the driving lever includes an intermediate region disposed between the coupling tip and the engaging region. A first bend is disposed between the coupling tip and the intermediate region, the first bend having an angle between about 20 degrees and 90 degree. A second bend is disposed between the engaging region and the intermediate region, the second bend having an angle between about 0 degrees and about 20 degree.

In yet another detailed aspect of an exemplary embodiment, the driving lever includes a grip disposed about the elongated body proximate to the second end configured to be held by as user when the driving lever is used as a spanner of a lug wrench, having a wrench socket disposed on the coupling tip.

In yet another detailed aspect of an exemplary embodiment, the socket storage assembly includes a storage body coupled the first sidewall of the body. The storage body defining a plurality of recesses configured each configured to receive a single wrench socket. The assembly can further include a plurality of wrench sockets sized to mate with lug nuts of a vehicle tire.

In yet another detailed aspect of an exemplary embodiment, the lever storage assembly includes a plurality of holders spaced apart along the second sidewall of the body.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
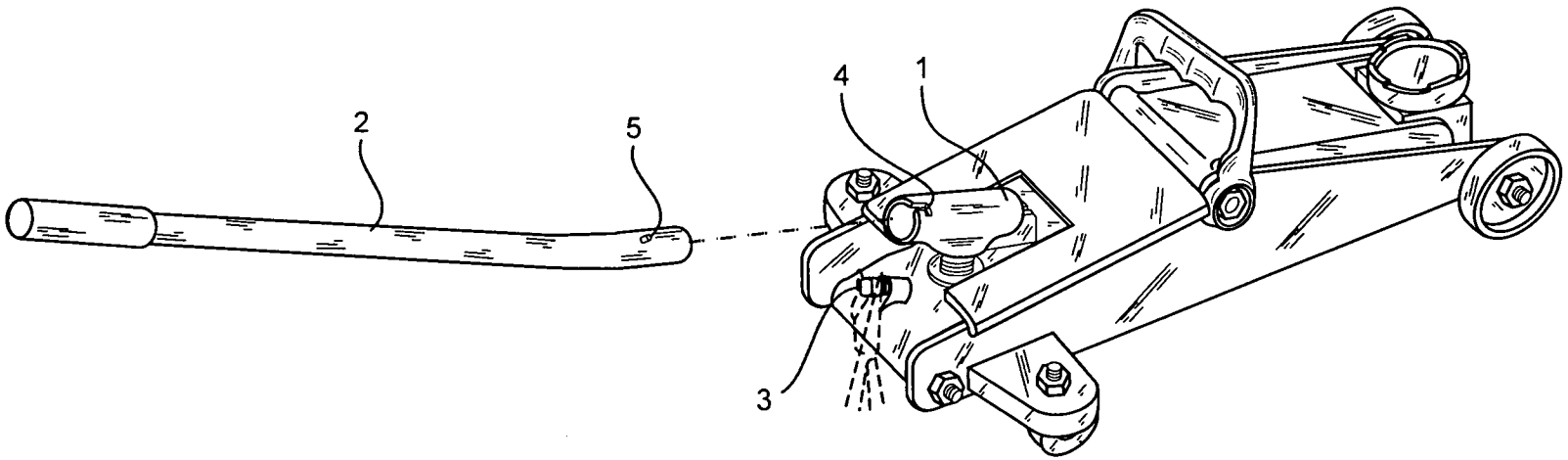
Prior Art FIG. 1
FIG. 1 is an exploded view of a conventional car jack.
Figure 2:
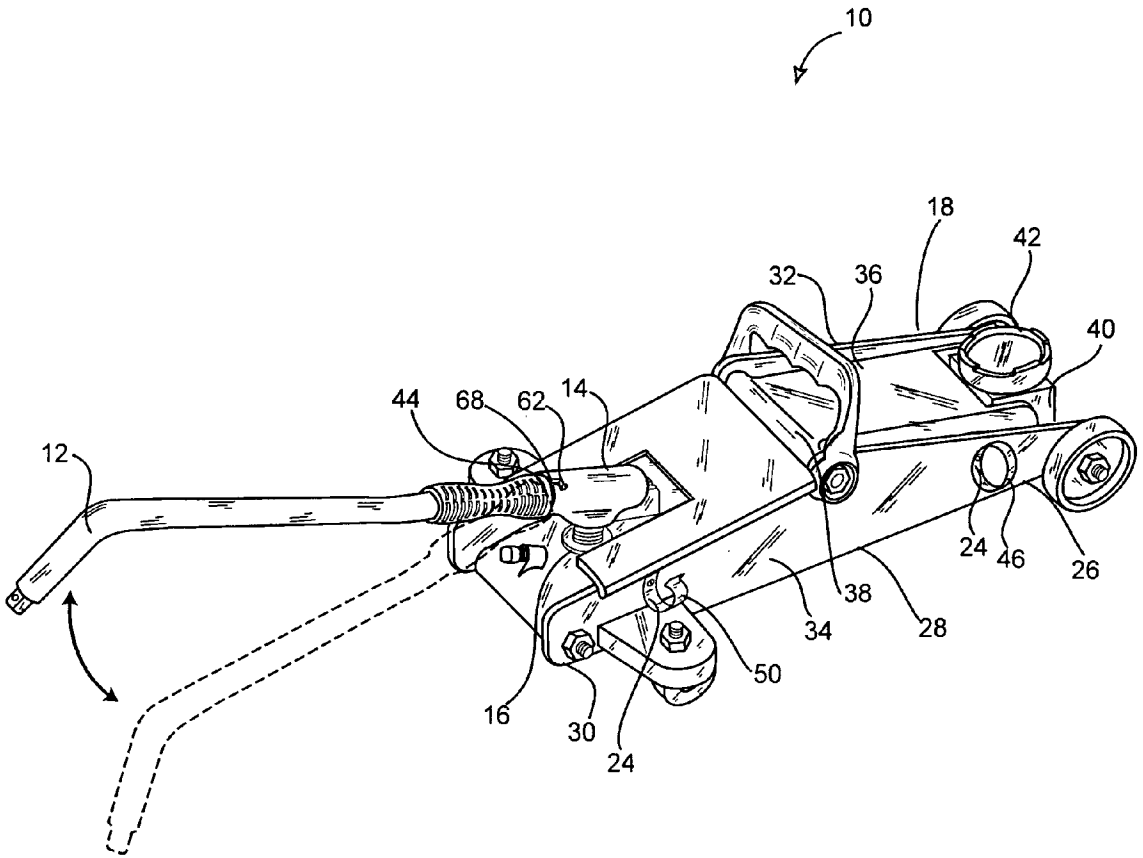
FIG. 2 is a perspective view of a combined car jack and lug wrench assembly in accordance with the invention, depicting a driving lever secured to a driving head of the car jack.

Referring now to the drawings, and particularly FIG. 2, there is shown a combined car jack and lug wrench assembly 10 having a driving lever 12 configured to be used both to engage a driving head 14 for operating a hydraulic system 16 of the car jack and to be used as a spanner of a lug wrench assembly. The assembly includes a jack body 18, a socket storage assembly 20 (FIG. 4) disposed on the body for housing wrench sockets 22 (FIG. 4), and a lever storage assembly 24 disposed on a sidewall of the body configured to secure the driving lever along a sidewall of the body, when not in use.

The body 18 includes a front portion 26, an intermediate region 28, and an end portion 30. The body comprises first and second sidewalls 32, 34 spaced apart from each other. A lift arm 36 is coupled to the body. The lift arm has a first end 38 pivotally coupled to the intermediate region of the body and a second end 40 proximate to the front portion. The car jack further includes a top plate 42 coupled to the second end of the lift arm. The top plate configured to engage a lifting location of an object to be lifted. The hydraulic system of 16 the car jack is housed within the body and configured to raise the lift arm. The hydraulic system is operated by the driving head 14, which is pivotally coupled to the end portion 30 of the body. In use, an engaging portion 44 of driving lever 12 in inserted into an aperture of the driving head to operate a hydraulic system, as discussed below.

Figure 4:
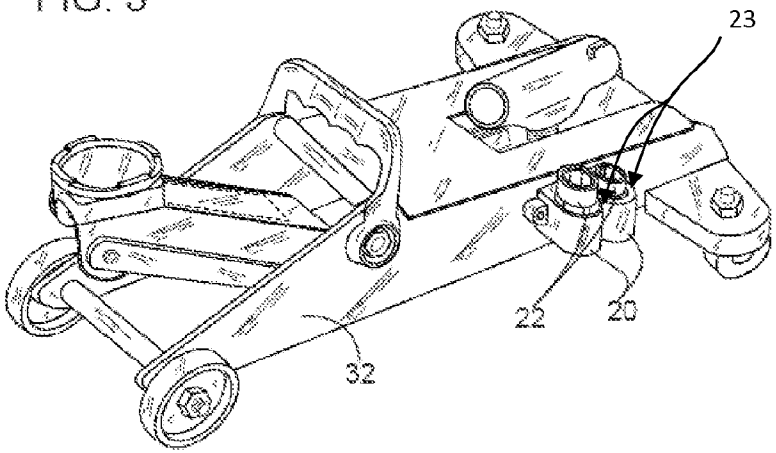
FIG. 4 is a perspective view of the combined car jack and lug wrench assembly of FIG. 2, depicting a socket storage assembly housing a plurality of wrench sockets.

With reference now to FIG. 4, the socket storage assembly 20 houses at least one wrench socket 22. In the exemplary embodiment, the socket storage assembly includes a storage body 21 coupled the first sidewall 32 of the body. The storage assembly defines a plurality of recesses 23, each configured to receive a single wrench socket. Preferably, the socket storage is configured to house wrench sockets useable with lug nuts for vehicle tires. In this manner, a user has convenient access to wrench sockets commonly used.

In other embodiments, various other configurations can be used for storing wrench sockets. For example, the socket storage assembly can include posts configured to mate with wrench sockets.

Figure 5:
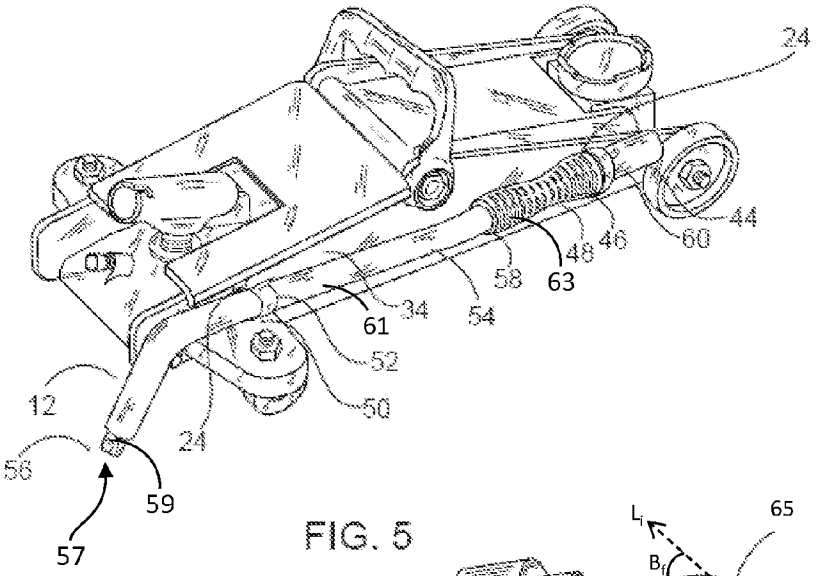
FIG. 5 is a perspective view of the combined car jack and lug wrench assembly of FIG. 2, depicting the driving lever disposed on a lever storage assembly.

With reference now to FIG. 5, the lever storage assembly 24 includes a plurality of holders spaced apart along the second sidewall 34 of the body. In use, the driving lever is received by the holders such the lever is longitudinally aligned along the second sidewall of the jack body. The holders are configured to hold the lever securely. In the exemplary embodiment, a first holder 46 disposed adjacent to the front end. The first holder includes upper and lower ends attached to the sidewall defining an aperture 48 for receiving an end of the lever. The lever is inserted axially into the aperture. The second holder 50 is disposed adjacent to the back end of the body. The second holder 50 is generally u-shaped defining an upper opening 52 for receiving the lever. In the exemplary embodiment, the second holder is formed to deflect upon insertion of the lever through the opening 52 to maintain the lever securely.

With reference now to FIG. 5, the driving lever 12 includes an elongated lever body 54 having a coupling tip 56 at a first end 57 of the elongated body for securing a socket 22. A retaining knob 59 is disposed along a side of the coupling tip 56 for mating a wrench socket to the coupling tip. The driving lever further includes a grip 58 fixedly provided proximate to a second end 60 of the elongated lever body, enabling a user conformably hold the lever when used with a socket attached to the coupling tip. The grip is formed of elastomeric material. The grip includes a plurality of circumferential rings (ribs 63) spaced along the longitudinal length of the grip.

In the exemplary embodiment, the elongated lever body 54 has a generally tubular configuration, formed of unitary construction. In other embodiments, the lever body can be formed of multiple sections without departing from the invention.

The driving lever 12 further includes the engaging portion 44, which extends beyond the grip 58 towards the second end 60 the lever body 54. The engaging portion includes a locating pin 62 perpendicularly extended from the periphery. A retaining hole 64 is axially formed at the second end.

Figure 6:
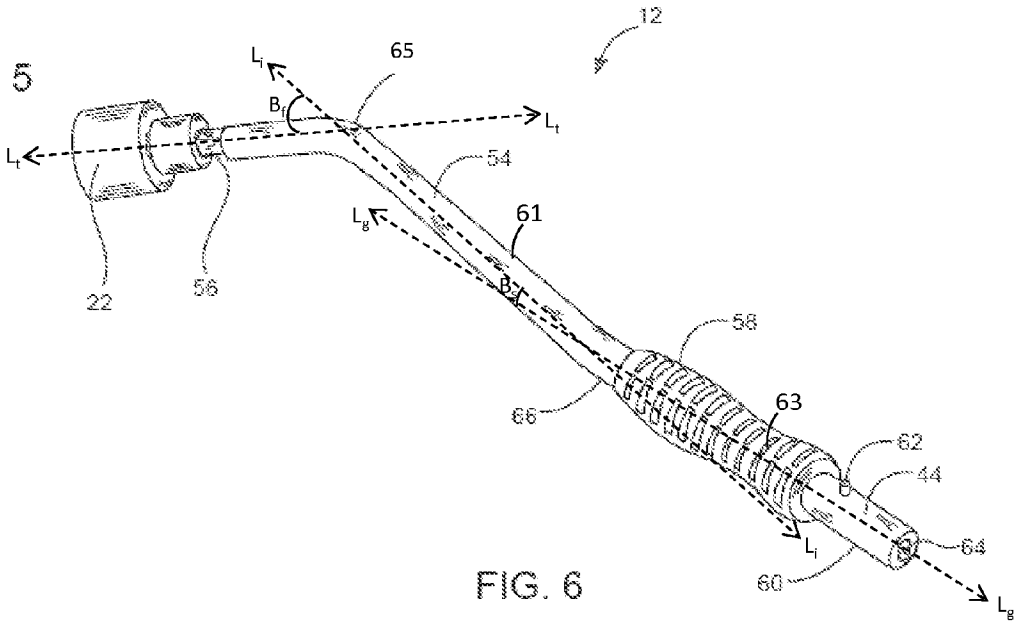
FIG. 6 is an elevational view of the driving lever and a wrench socket of FIG. 2.
Figure 7:
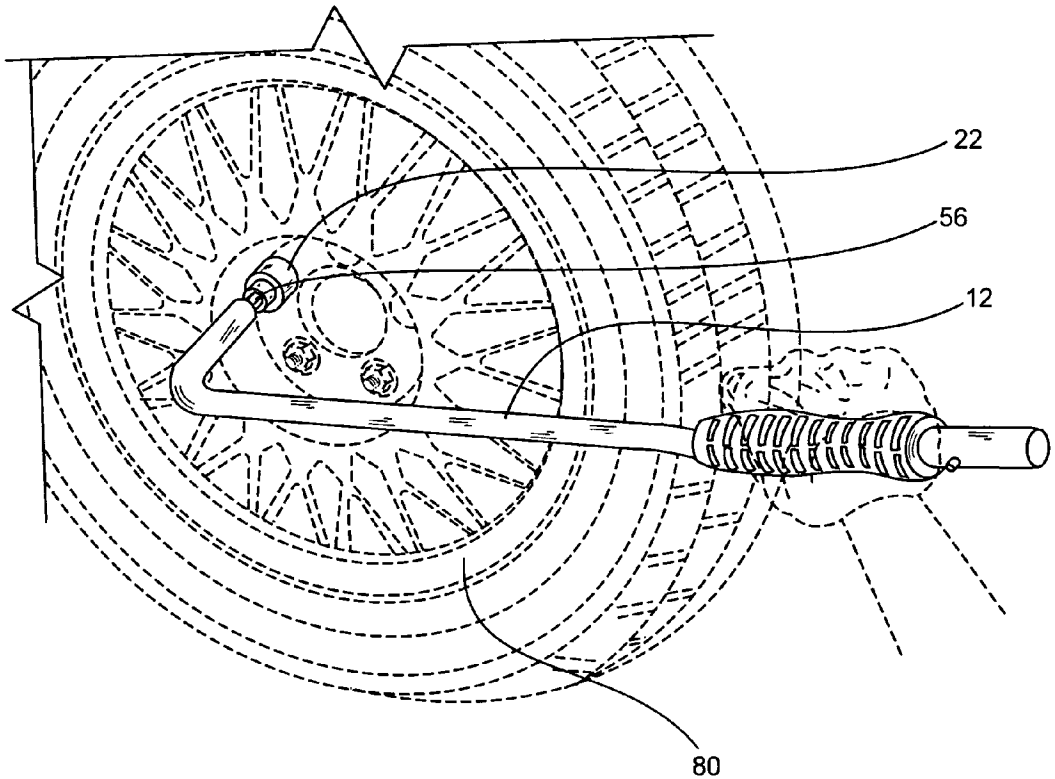
FIG. 7 is a perspective view of driving lever and a wrench socket of FIG. 4, depicting use as a lug wrench in conjunction with lug nuts of a vehicle tire.

In the exemplary embodiment, as best seen in FIG. 6, the elongated tubular body 54 of the driving lever 12 has a first bend 65 proximate to yet from spaced from coupling tip 56, and a second bend 66 proximate to the second end 60 and the grip 58. The first bend has an angle ($B_f$) preferably between about 20 degrees and 90 degrees, as measured between a longitudinal axis (Li) of the intermediate region and a longitudinal axis ($L_t$) of the tip region. The second bend ($B_s$) has an angle between about 0 degrees and 30 degrees, as measured between a longitudinal axis (Li) of the intermediate region and a longitudinal axis ($L_g$) of the grip region. Preferably, the first and the second bends are in opposite directions such that the body has a slight s-shape. In other words, in a prescribed orientation, the coupling tip projects downward relative to a longitudinal axis of the intermediate region 61, and the engaging region projects upwards relative to a longitudinal axis (Li) of the intermediate region. In other embodiments, the second bend can be excluded entirely.

As shown in FIG. 2, the engaging portion 44 of the driving lever 12 is inserted into the driving head 14 of the car jack and then the driving lever is rotated through an angle to force the locating pin 62 into positive engagement with the locating notch 68 of the driving head 14 so that the driving lever can be pulled alternatively up and down to lift the car jack.

Figure 3:
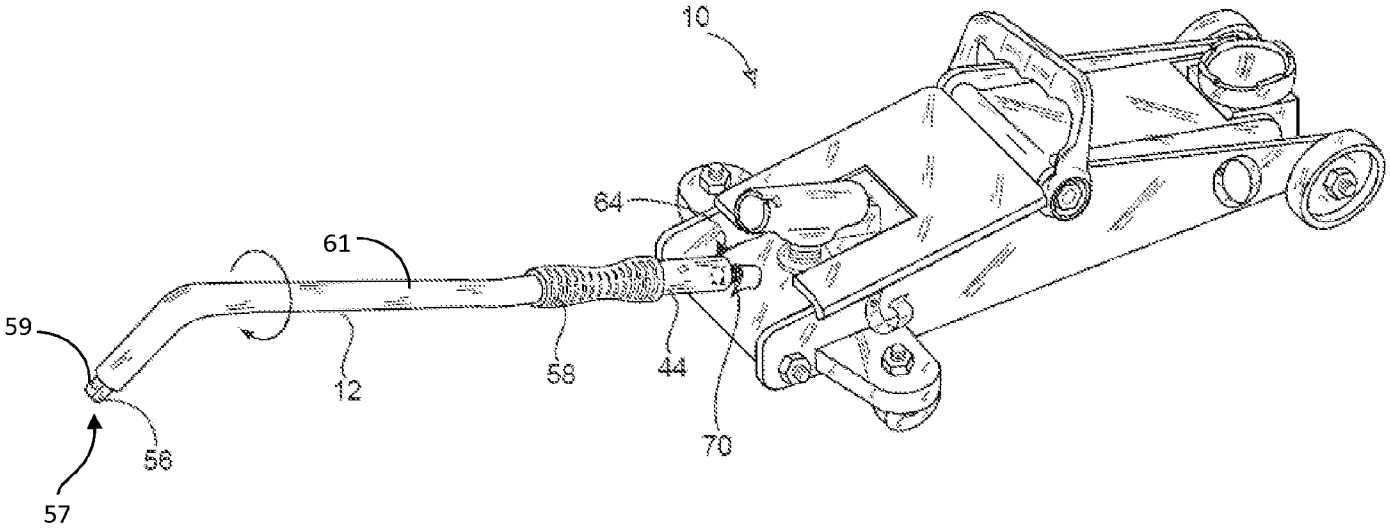
FIG. 3 is a perspective view of the combined car jack and lug wrench assembly of FIG. 2, depicting the driving lever secured to the rotary lock bolt of the car jack.

As shown in FIG. 3, the driving lever 12 can be used to turn the rotary lock bolt 70 between the locked position and the unlocked position. More particularly, the rotary lock bolt is received within the retaining hole 64 of the driving lever, and then the driving lever is turned to rotate the rotary lock bolt, to operate a locking mechanism for the hydraulic system. The retaining hole can have various configurations without departing from the invention, such as circular, plume flower, hexagonal, and so on, and can include or exclude features such as a transverse rib, without departing from the invention.

With reference to FIG. 6, a lug wrench 80 is shown having a wrench socket 22 attached to the coupling tip 56 of the driving lever 12, such that the driving lever serves as a spanner for the lug wrench. The grip is sufficiently spaced apart from the wrench socket allowing a user to comfortably torque the lug wrench. In addition, the first and second bends of the lever body further facilitate torquing of the lug wrench as well as a facilitating ample clearance of adjacent structure commonly found on vehicles.

It should be appreciated from the foregoing that the present invention provides a combined car jack and lug wrench assembly having a driving lever configured to be used both to engage a driving head for operating a hydraulic system of the car jack and to be used as a spanner of a lug wrench assembly. The assembly can include a car jack body, a socket storage assembly disposed on the body for housing wrench sockets, and a lever storage assembly disposed on a sidewall of the body configured to secure the driving lever along a sidewall of the body, when not in use.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A combined car jack and lug wrench assembly, comprising:

a body having a front portion, an intermediate region, and an end portion, the body further having first and second sidewalls spaced apart from each other;

a lift arm having a first end pivotally coupled to the intermediate region of the body and a second end proximate to the front portion;

a top plate coupled to the second end of the lift arm, the top plate configured to engage a lifting location of an object to be lifted;

a driving head pivotally coupled to the end portion of the body to operate a hydraulic system housed within the body and configured to raise the lift arm, the driving head defining an opening and a locating notch at a distal end thereof;

a rotary lock bolt disposed proximate to the end portion of the body, the rotary lock bolt operatives a locking mechanism of the hydraulic system; and a driving lever having an elongated body with a first end, a second end, and an intermediate region disposed between the first end and the second end, the driving lever having a first bend disposed between the first end and the intermediate region, the driving lever further having a coupling tip at the first end of the driving lever, the coupling tip having a rectangular cross-section configured to mate with a wrench socket, a retaining knob is disposed along a side of the coupling tip to secure a wrench socket to the coupling tip, the second end of the driving lever sized to conformably mate with the driving head to operate the driving head, a retaining hole axially at a distal tip of the second end of the driving lever, the retaining hole conformed to mate to with the rotary lock bolt to operate the rotary lock bolt, a locating pin extending perpendicular from the elongated body and disposed at a prescribed location from the distal tip of the second end to engage the locating notch of the driving head, and a grip disposed about the elongated body proximate to the second end configured to be held by a user when the driving lever is used as a spanner of a lug wrench, in which a wrench socket is disposed on the coupling tip, the grip is spaced from the distal tip of the second end so that the grip abuts the opening to the driving head when the driving lever is mated to the driving head with the locating pin engaged in the locating notch.

2. The combined car jack and lug wrench assembly as defined in claim 1, wherein the grip has a plurality of ribs in angularly space relationship.

3. The combined car jack and lug wrench assembly as defined in claim 1, wherein the first end is oriented relative to the second end such that the first end is oriented downward when the second end is mated to the driving head with the locating pin engaged in the locating notch.

4. The combined car jack and lug wrench assembly as defined in claim 1, further comprising a wrench socket that mates with the coupling tip of the driving lever.

* * * * *